US005087238A

United States Patent [19]

Olson

[11] Patent Number: 5,087,238

[45] Date of Patent: Feb. 11, 1992

[54] FORMS CARRIER FOR LASER PRINTERS

[75] Inventor: Heidi S. Olson, Barrington, Ill.

[73] Assignee: HICO Products, Inc., Barrington, Ill.

[21] Appl. No.: 561,175

[22] Filed: Aug. 1, 1990

[51] Int. Cl.[5] ..... B65H 5/28

[52] U.S. Cl. ..... 493/379; 493/325; 229/69

[58] Field of Search ..... 229/69; 282/11.5 A, 282/11.5 R; 281/5, 2; 493/320, 325, 379, 386, 324, 331, 334, 375, 383, 216

[56] References Cited

U.S. PATENT DOCUMENTS

| | | | |
|---|---|---|---|
| 4,066,206 | 1/1978 | Peterson | 282/11.5 A X |
| 4,335,845 | 6/1982 | Dierks et al. | 229/69 |
| 4,487,645 | 12/1984 | Weston | 281/5 X |
| 4,545,517 | 10/1985 | Olson | 226/92 |
| 4,586,651 | 5/1986 | Bradley | 493/216 X |
| 4,591,146 | 5/1986 | Sasso | 282/11.5 X |
| 4,705,297 | 11/1987 | Wakeman | 229/69 X |
| 4,759,484 | 7/1988 | Richter . | |
| 4,884,826 | 12/1989 | Slagsvol . | |
| 4,928,875 | 5/1990 | Hutchinson | 229/69 X |

OTHER PUBLICATIONS

"Continuous Form with Insert Pocket", J. V. Sharp, IBM Tech. Discl. Bulletin, vol. 2, No. 2, Aug. 1959.

*Primary Examiner*—William E. Terrell
*Assistant Examiner*—John A. Marlott
*Attorney, Agent, or Firm*—Malin, Haley, McHale DiMaggio & Crosby

[57] ABSTRACT

A Forms Carrier is disclosed for use in securing preprinted business forms that are too small to engage laser printers or similar friction roller printing devices. The Forms Carrier includes a rectangular sheet of flexible material having a fold line dividing the sheet into a lower portion and a upper portion. The lower portion resembles a conventional size sheet of paper. A preprinted business form is placed upon the lower portion of the sheet and the upper portion folds over the form with a pressure sensitive adhesive on the surface of the upper portion that faces the form which securely holds the form to the Forms Carrier. The Forms Carrier with the secured form is then placed into a laser printing device or similar friction roller printing device in the ordinary and conventional manner.

6 Claims, 1 Drawing Sheet

FORMS CARRIER FOR LASER PRINTERS

BACKGROUND OF THE INVENTION

This invention relates generally to the printing of forms, and, more particularly, to a means for carrying preprinted business forms into laser printers, and the like.

The computer and related technology industries have provided consumers with a variety of printing devices over recent years. Whether the printing device is a computer peripheral or a stand alone device, the printing device's primary function is to convert data into a permanent medium. The type of permanent medium depends upon the type of printing device. A dot matrix tractor feed printing device is commonly used as a peripheral to a computer. The tractor feed printer uses continuous paper as the permanent medium, the paper having border line pin holes for placement over the tractor feed mechanism. After printing, this paper must be separated if conformance to conventional 8½"×11" size paper is desired. The high speed and continuous feed characteristics of the tractor feed printing device lends itself to printing upon preprinted business forms such as bank drafts, checks, sales agreements, invoices, purchase orders, and the like.

The current trend in the computer and related technology industry is to use laser printing devices that produce a quality of print not possible with dot matrix tractor feed printers. The laser printing devices print on conventional sized paper with automatic feeding of the paper at speeds comparable to tractor feed printers using continuous feed paper.

As consumers acclamation to the higher quality laser printer is heightened, the demand for laser printers to perform the printing of preprinted forms in place of printing by lower quality dot matrix tractor feed printers becomes apparent. The problem, which the present invention addresses, is that current laser printers utilize friction rollers for a mechanical feed system to draw forms into the laser printer. Friction rollers do not provide continuous form contact due to their circular design leaving spaces between rollers in which improperly sized sheets can stray causing jams or misalignment. Laser printer manufactures are aware of this problem and publish recommended minimum sheet lengths and widths to prevent paper jams or misalignment, however, not all preprinted forms can conform to the manufacturers recommendation. Further, if only a portion of a preprinted form is printed upon and the form is sequential, the remainder of the form cannot be discarded. For example, payroll checks can be purchased for use on a Hewlett Packard IIP LaserJet printer (4) checks are preprinted on a single 8½" width×11" length piece of paper but only two (2) checks are used, the remaining checks would be 8½" width×5½" length which is below the minimum 7½" length recommended by Hewlett Packard. The current solution is to type out the checks manually, a solution that by-passes the reason for computer check printing and the automatic accounting process available with the service. An attempt to disregard the manufacturers minimum length recommendation by placing the remaining checks into the LaserJet is likely to cause a paper jam or misalignment of the checks. The end result is probable destruction of the checks causing waste of paper, operator time, and check sequential accountability problems.

The aforementioned problem is not limited to business forms, as demonstrated by the laser printer manufacturers method of envelope printing. Due to the small size of envelopes, laser manufacture's utilize special trays to rotate the envelope 90 degrees so that the envelope enters the printer in a lengthwise direction preventing paper jams due to the small size of the envelope. In addition, the printer is required to print in a 90 degree or "landscape" orientation as the envelope is now rotated. To print in such a fashion the operator must input commands to deviate from the normal portrait position or learn how to use optional programming commands in word processing programs. WordPerfect or WordStar are two such programs that have special functions for printing envelopes due to the required rotation.

The problems associated with laser printers can be found on nearly every printing device that utilizes friction rollers. For instance, a machine copier such as the Xerox copier with an automatic feeder employs friction rollers. When small items, such as a single check, are machine copied the operator is usually limited to manual placement of the check upon the lens in lieu of using the automatic feed option commonly limited to conventional sized paper.

Yet another friction roller printing device is the facsimile machine. If a small item is to be sent through the device, an operator usually makes a Xerox machine copy so the item can be fed through the multiple page feeder. Placement of a small item in the automatic feeder usually results is a paper jam.

The problems described are those which plague the use of friction roller printing devices. While extensive efforts have been made toward effectively and simply resolving these problems, no satisfactory solution has heretofore been provided. My invention is specifically designed to overcome the aforementioned friction roller feed problems and further withstand the rigors of laser printer operation. It is, therefore, to the effective resolution of these problems that the present invention is directed.

SUMMARY OF THE INVENTION

The principle object of the present invention is to provide a simple and reliable means which overcomes the difficulties previously mentioned when using forms or other non-conventional sized items whose size is less than the minimum dimensions prescribed for a friction roller printing device.

In accordance with this invention, my Forms Carrier, hereinafter the "Carrier", is formed from a single sheet of rectangular flexible material. The sheet has a fold line dividing it into a lower portion and an upper portion. The preferred dimensions of the lower portion is the same as a conventional 8½"×11" sheet of paper, however, the dimensions are a function of the printing device and the Carrier need only meet the minimum recommended dimensions of a friction roller device. The size of the upper portion of the sheet is less than the lower portion, preferably ⅛ inch to about 1 inch in length. The upper portion folds over at the fold line creating a leading edge on the outside of the fold line where the upper and lower portions meet. One surface of the upper portion includes a pressure sensitive adhesive strip which extends along at least a portion of the upper portion.

To use the Carrier, a preprinted business form, hereinafter the "form" is placed upon the lower portion of the Carrier with the edge of the form flush against the fold line. The upper portion is then folded over the form whereby the pressure sensitive adhesive strip adheres to the form securing the form in a fixed position. The Carrier is then used as if the form and Carrier were a singular sheet of material.

Accordingly, it is an object of the present invention to provide a means for enabling a preprinted business form, whose dimensions are too small to be fed into a laser printer, to be placed upon the Carrier and be fed into a laser printer. The Carrier maintaining the form in a fixed position so that the laser printing device accepts the Carrier, and attached form, as a single sheet of material.

Yet another object of the present invention is use of perforations in formation of the fold line thereby providing a low profile leading edge for ease of feeding into printing devices and ease of form alignment against the fold line. Use of perforations further permits disregard of grain direction in the sheet material during formation of the fold line.

Another object of the present invention is to provide a means of form alignment by use of adhesive only on one surface of the upper portion. The form is then free to slide without obstruction upon the lower portion until the edge of the form is flush against the fold line of the Carrier. Thereafter the upper portion with the adhesive is pressed against the form securing the form to the Carrier. Adhesive may be placed on the lower portion in those instances where form sliding is not necessary, or placed simultaneously upon the upper and lower portions.

Still another object of the present invention is to use materials of construction that withstand repeated subjection to the temperatures of printing devices, such as LaserJet printers whose fusing temperatures exceed 200 degrees Centigrade for 0.1 seconds, without curling.

Yet still another object of the present invention is to provide a means of printing envelopes on a laser printing device by use of portrait orientation.

Still another object of the present invention is to provide a means for feeding documents, either horizontally or vertically, whose materials of construction provide insufficient rigidity for a printing device. For example, when thermal paper is secured to the Carrier, the adhesive of the upper portion secures the thermal paper allowing delivery through an automatic feeding mechanism of a copying machine. The principle being that a conventional copying machine uses friction rollers that only contact the back surface of the Carrier.

Yet another object of the present invention is to provide a Forms Carrier that is inexpensive to manufacture and reuseable.

Other objects and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION OF THE INVENTION

As required, detailed embodiments of the present invention are disclosed herein, however, it is to be understood that the disclosed embodiments are merely exemplary of the invention which may be embodied in various forms. Therefore, specific functional and structural details disclosed herein are not to be interpreted as limiting, but merely as a basis for the claims and as a representative basis for teaching one skilled in the art to variously employ the present invention in virtually any appropriately detailed structure.

Figure 1:
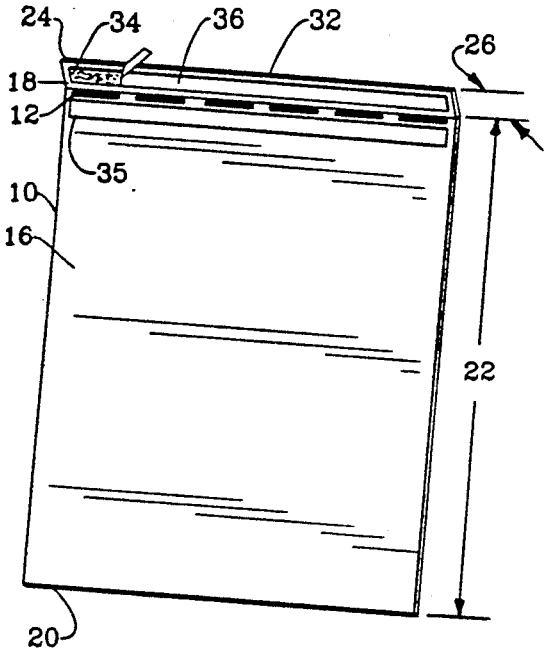
FIG. 1 is a perspective view showing the Forms Carrier of the present invention.

Referring to the drawings in more detail, FIG. 1 is my Forms Carrier 10, hereinafter referred to as the "Carrier", fabricated from a rectangular singular sheet of flexible material, preferably paper in the 16 to 28 pound (60 to 90 g/m$^2$) range capable of withstanding the 200 degree Centigrade fusing temperatures of laser printing devices with minimal curl. The width of the sheet is determined by the constraints of the laser printing devices, the preferred width being 8½ inches in accordance with conventional paper.

A fold line 12 is created in the sheet by spaced apart perforations 14 or comparable crease making means dividing the sheet into a lower portion 16 and a upper portion 18. The lower portion 16 of the sheet 10 extends outwardly from fold line 12 to a first trailing edge 20 at a length 22 between 7 inches and 14 inches, distance exceeding the minimum sheet size tolerance of the printing device, the preferred embodiment being 11 inches. The upper portion 18 of the sheet extends outwardly from the fold line 12 to a second trailing edge 24 at a length 26 less than the lower portion distance, preferably ⅛ inch to about 1 inch in length. The fold line 12 also doubles as an alignment tool, the significance of which will become evident later in this description. The fold line 12 must be made parallel with the lower portion trailing edge 20 allowing an undersized item to maintain a straight edge. It should be understood that the fold line may also run longitudinally. Use of a plurality of perforations 14 for the creation of fold line 12 permits superior alignment characteristics when long grain paper stock material is used for the carrier. Use of perforations further provides a leading edge 28, when the upper portion is folded upon the lower portion, resembling a sharp cut.

The upper portion 18 further consists of an outside surface 30 and an inside surface 32. The inside surface 32 has a pressure sensitive acrylic-based emulsion adhesive strip 34 which extends along at least a portion of the inner surface 32. Commercially available two-sided tapes may also be used if they are stable with the temperatures encountered in the laser printer's fusing process. A protective strip 36 is used to protect the adhesive tack when the adhesive strip 34 is not in use. It should be noted that adhesive 35 may be placed on the lower portion in those instances where form sliding is not necessary, or placed simultaneously upon the upper and lower portions.

Figure 2:
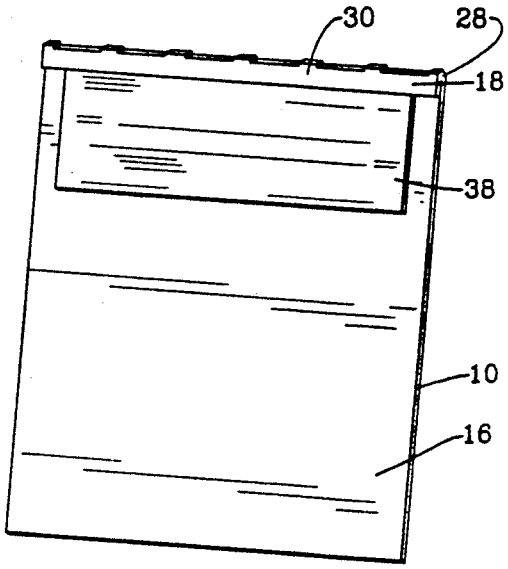
FIG. 2 is a perspective view showing the placement of a preprinted business form in the Forms Carrier.

Referring to FIG. 2 an undersized preprinted business form 38 is shown placed upon the lower portion 16 of the Carrier 10. The top edge of the form 38 is flush against the fold line 12. The protective strip 36 is removed from the adhesive 34 and the upper portion 18 is folded over at fold line 12 and pressed against the form 38 to secure it to the adhesive 34 creating a leading edge 28 capable of insertion into a laser printer and the like.

Figure 3:
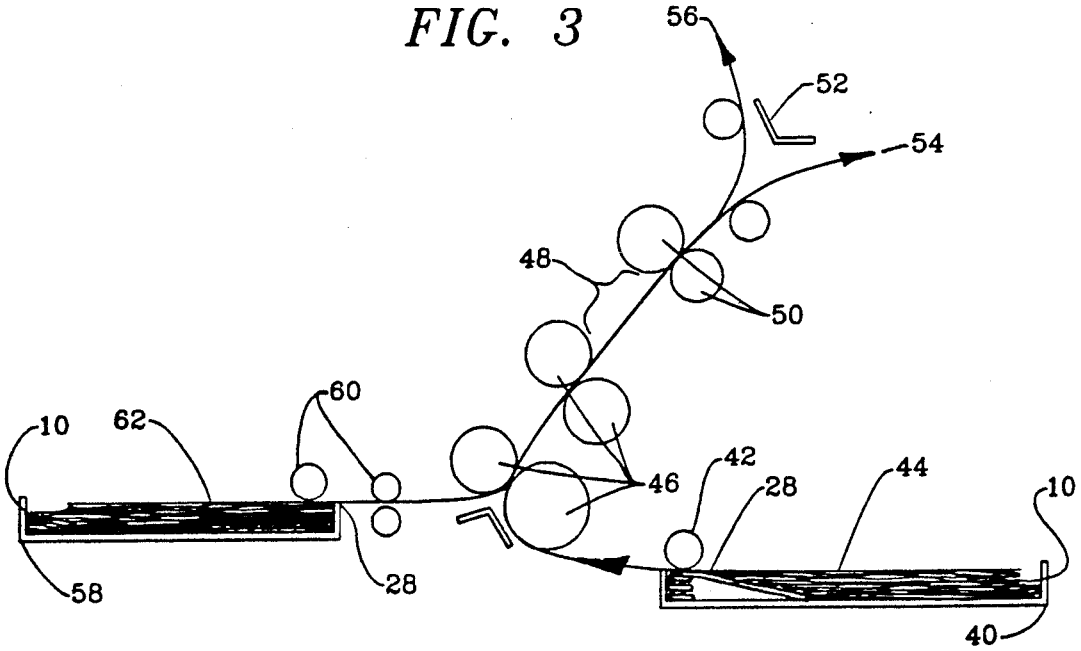
FIG. 3 is a fragmentary perspective view of a typical feed arrangement for a Forms Carrier into a friction roller laser printing device.

Referring to FIG. 3 by way of example, the Carrier 10 is placed into a typical laser printing device forward feeding tray 40 with the leading edge 28 closest to the printer intake, the form 38 to be printed upon facing downward. When the laser printing device is commanded to print, the Carrier 10 is pulled into the device by use of a friction roller 42 pressed against the back 44 of the Carrier 10. Once the Carrier 10 is drawn into the laser printing device it enters a series of rollers 46 using friction to propel the Carrier 10 into the fusing area 48 where the print is applied to the form 38. A further set of friction rollers 50 lead the Carrier 10 out of the laser printing device and depending upon the lever 52 direction, propels the Carrier 10 either in a forward direction 54 or rearward direction 56. The length and rigidity of the Carrier 10 prevents misalignment or jamming of the form by providing a backing sheet of material while "carrying" the form through the laser printing device without impairing the printability of the form.

The use of a rear feeding tray 58 allows the Carrier to function in a similar manner as previously described whereby the Carrier 10 is placed into a typical laser printing device rearward feeding tray 58 with the leading edge 28 closest to the printer intake, the form 38 to be printed upon facing upward. When the laser printing device is commanded to print, the Carrier 10 is pulled into the device by use of friction rollers 60 pressed against the upper portion 18 of the Carrier 10 and form 38. The adhesive 34 holding the form 38 securely in place against the front surface 62 of the Carrier 10 provides sufficient friction to maintain the form 38 in its fixed position when pressed together between the friction rollers 60. Once the Carrier 10 is drawn into the laser printing device, it enters a series of rollers 46 using friction to propel the Carrier 10 into the fusing area 48 where the print is applied to the form 38. A further set of friction rollers 50 lead the Carrier 10 out of the laser printing device and depending upon the direction lever 52 propels the Carrier 10 either in a forward direction 54 or rearward direction 56.

If a copy of the form 38 is desired, the Carrier 10 can be placed into the automatic feeder of a photo copy machine or sent by facsimile while held securely by the Carrier. To remove the form 38, the upper portion 18 of the carrier 10 is lifted thereby releasing the adhesive strip 34 from the form 38. The pressure sensitive adhesive 34 is a low tack adhesive permitting repetitive securing of forms to the Carrier for reusability. The adhesive strip 36 can be reapplied over the adhesive 34 to maintain tack for future applications.

It is to be understood that while I have illustrated and described certain forms of my invention, it is not to be limited to the specific forms or arrangement of parts herein describe and shown. It will be apparent to those skilled in the art that various changes may be made without departing from the scope of the invention and the invention is not to be considered limited to what is shown in the drawings and described in the specification.

What I claim as new and desire to secure by Letters Patent of the United States is:

1. A method of transporting a plurality of forms through a printing device comprising friction-roller transport means, in which a reusable forms-carrier is provided comprising a reusable sheet of rectilinear-shaped, flexible material, the said sheet having a fold-line along its width dividing the sheet into an upper portion and a lower portion that are pivotal relative to each other via the fold-line; the inner surface of the upper portion having a pressure-sensitive adhesive strip along a portion of the width thereof, said method comprising:

(a) pivoting the upper portion relative to the lower portion along the fold lien so that the fold line forms an apex between the lower portion and the upper portion;

(b) inserting a form to be printed in the printing device on the first portion of the forms-carrier; said step comprising placing the upper edge of the form against the fold-line for substantial linear alignment therewith along the fold line; said step causing the form to be sandwiched between the upper and lower portions;

(c) pivoting the upper surface after said step (b) until the adhesive strip thereof contacts against a portion of the form juxtapositioned thereat;

(d) thereafter, inserting the forms-carrier with form into the friction-roller transport of the printing device, and printing the form;

(e) thereafter, separating the adhesive strip from its contact with the form, and removing the form from the forms-carrier; and (f) repeating said steps (b) through (e) a second time for a different form to be printed with the same forms-carrier.

2. In a printing device comprising friction-roller transport means for transporting paper therethrough, the improvement comprising:

a separate, independent reusable forms-carrier for carrying a form through said friction-roller transport means of said printing device, said forms-carrier comprising a reusable sheet of rectilinear-shaped, flexible material having at least two surface faces, and four free edges, said sheet having a length and a width;

said sheet having a fold-line across said sheet parallel to one of the edges and along said width, said fold line having a first edge surface and second opposite, parallel edge surface, said fold line dividing said sheet into an upper portion and a lower portion, said lower portion extending from said first edge surface of said fold line and terminating in a first trailing edge, said upper portion extending from said second edge surface of said fold line and terminating in a second trailing edge; each of said lower and upper portions having an interior surface and an exterior surface and being pivotal relative to each other via said fold-line;

a pressure-sensitive adhesive strip on a portion of said inner surface of said upper portion, said adhesive strip being positioned between said fold line and said second trailing edge and extending along at least a portion of said width of said inner surface;

a form on said sheet of said forms-carrier having a size less than said sheet of said forms-carrier, said form having an upper edge abutting against said fold-line for substantial linear alignment therewith along said fold line; said upper portion with said pressure-sensitive adhesive strip overlying said form with said form being sandwiched between said upper and lower portions, said adhesive strip contacting a portion of said form for removably securing the form thereby, said forms-carrier transporting said form through said friction-roller transport means.

3. The improvement according to claim 2, wherein said adhesive strip comprises a two-sided tape having a first side of high tack for securement against said upper portion and low tack for removable securement against said form.

4. The improvement according to claim 3, wherein said printing device comprises a laser printer.

5. The improvement according to claim 2, wherein said fold-line comprises a line of perforations.

6. The improvement according to claim 2, wherein said form has a width and length less than the width and length, respectively, of said sheet of said forms-carrier.

* * * * *